United States Patent [19]

Arfert et al.

[11] Patent Number: 4,748,816

[45] Date of Patent: Jun. 7, 1988

[54] METHOD FOR THERMALLY TREATING FILLED CANS

[75] Inventors: Horst F. W. Arfert, Chesterfield County; Roger H. Donaldson, Lancaster County; Harry W. Lee, Jr., Chesterfield County, all of Va.

[73] Assignee: Reynolds Metals Company, Richmond, Va.

[21] Appl. No.: 69,081

[22] Filed: Jul. 2, 1987

Related U.S. Application Data

[63] Continuation-in-part of Ser. No. 930,191, Nov. 10, 1986, abandoned.

[51] Int. Cl.[4] ..... F25D 13/00

[52] U.S. Cl. ..... 62/63; 62/374; 366/109; 99/348

[58] Field of Search ..... 62/63, 64, 380, 374; 165/120; 198/836, 446; 366/109, 218; 99/348

[56] References Cited

U.S. PATENT DOCUMENTS

| | | | |
|---|---|---|---|
| 1,617,630 | 2/1927 | Gay | 62/64 X |
| 1,939,087 | 12/1933 | Skinner | 62/375 X |
| 2,043,763 | 6/1936 | Meyer et al. | 259/54 |
| 2,477,992 | 8/1949 | Leonard | 62/104 |
| 2,597,223 | 5/1952 | Burgess | 99/214 |
| 2,677,248 | 5/1954 | Rexford et al. | 62/104 |
| 3,092,125 | 6/1963 | Kinsey | 134/125 |
| 3,144,740 | 8/1964 | Erickson et al. | 53/48 |
| 3,283,523 | 11/1966 | Long | 62/63 |
| 3,427,004 | 2/1969 | Cover et al. | 366/218 |
| 3,572,490 | 3/1971 | Babunovic | 198/22 |

*Primary Examiner*—William E. Wayner

*Attorney, Agent, or Firm*—Alan T. McDonald

[57] ABSTRACT

A method is described for cooling or heating hot filled containers, such as metallic cans. The apparatus employs countercurrent flow between the containers and a water trough and uses axial shaking and the physics of the containers to promote cooling or heating.

7 Claims, 4 Drawing Sheets

METHOD FOR THERMALLY TREATING FILLED CANS

CROSS-REFERENCE TO RELATED APPLICATIONS

This is a continuation-in-part of U.S. Application Ser. No. 930,191, filed Nov. 10, 1986, now abandoned.

BACKGROUND OF THE INVENTION

It is common practice to package beverages, such as beer and soft drinks, in metallic cans. The most prevalent type of metallic can today for beverage packaging is the two-piece aluminum can, comprising a drawn and ironed can body produced from a circular blank of aluminum and an aluminum end closure double seamed to a flange at the top of the can body. The end normally includes an easy-opening feature, such as a ring pull tab or a nondetachable tab opening structure.

Normally, due to the relatively weak sidewalls of the drawn and ironed aluminum container, the container employs the internal pressure of the carbonated beer or soft drink as a strengthening element. More recently, however, with the development of liquid nitrogen injection into filled containers, it has become feasible to package noncarbonated beverages, such as wines, juices, water and the like in aluminum cans. Of course, it is also known to package beverages, both carbonated and noncarbonated, in steel cans. In all such cases, the filled and sealed container includes a gaseous headspace above the product.

Unlike beer and soft drinks, which are packaged at or below room temperature, many of the noncarbonated beverages, especially fruit drinks, are packaged hot. After packaging, it is important to quickly cool the container and product, to avoid deterioration of the product.

Several apparatus have been disclosed in the past for can cooling. Thus, for example, U.S. Pat. Nos. 2,477,992; 2,597,223; 2,677,248 and 3,283,523 all disclose apparatus in which cans are conveyed along a conveying surface and sprayed with water to cool the cans. The cans are rotated along their path in order to aid the cooling process.

Unfortunately, it has been found that spray cooling does not provide sufficient contact between the water and the container for efficient cooling, resulting in the need for excess water usage and/or excess conveyor length. Further, since the containers were rolled along the conveying surface, damage to the containers and/or their graphics remained a problem.

In U.S. Pat. No. 3,092,125, a can cooler is described which employed countercurrent flow of the containers and a water trough along a portion of the conveying path and which employed water spray during another portion of the conveying path. Further, the cans were rocked in an arc in order to improve cooling of the contents. While improvement over the full water spray systems was accomplished, there remained the need for elimination of excess water consumption from water sprays, as well as the need for further improvements in container cooling.

Further, in all of the prior known apparatus for can cooling, movement of the container occurs merely by mechanical means, without using the physics of the container itself to aid in its cooling.

It is thus a primary objective of the present invention to employ the container as a major contribution to its own cooling.

THE PRESENT INVENTION

By means of the present invention, the shortcomings of the prior art can cooling systems have been overcome.

The present invention involves a method and apparatus for can cooling which employs countercurrent flow between the containers and water within a trough for the entire length of the cooling portion of the apparatus and which includes means for shaking the cans axially at a rate to allow the ends of the container to alternately rise and fall within the water trough due to their physics and thereby produce increased contact between the can interior surface and the contents thereof, promoting quicker cooling of the contents and thus reducing water usage by the system and the length of the system.

BRIEF DESCRIPTION OF THE DRAWINGS

The method and apparatus of the present invention will be more fully described with reference to the drawings in which.

DETAILED DESCRIPTION OF THE PREFERRED EMBODIMENT

Figure 1:
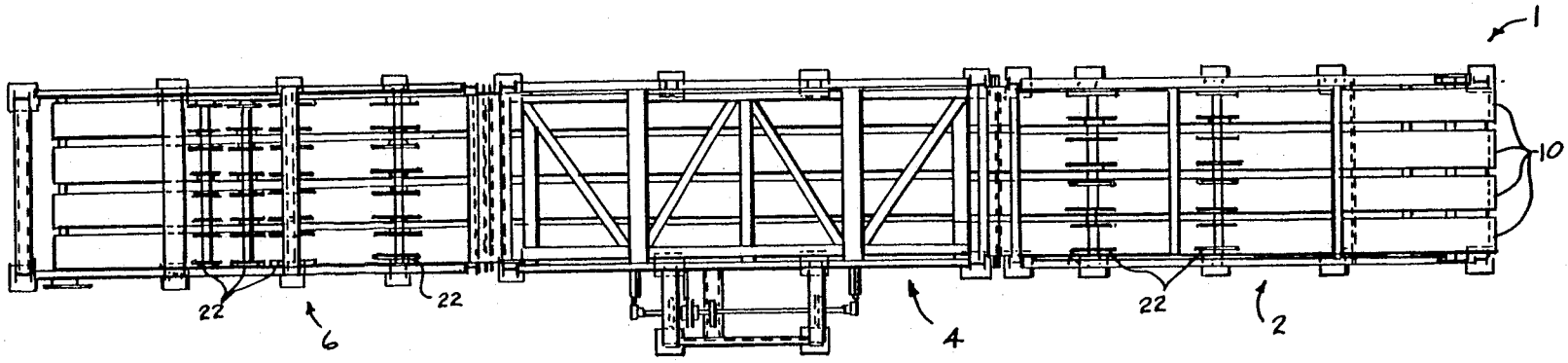
FIG. 1 is a top elevational view of the can cooler of the present invention.
Figure 2:
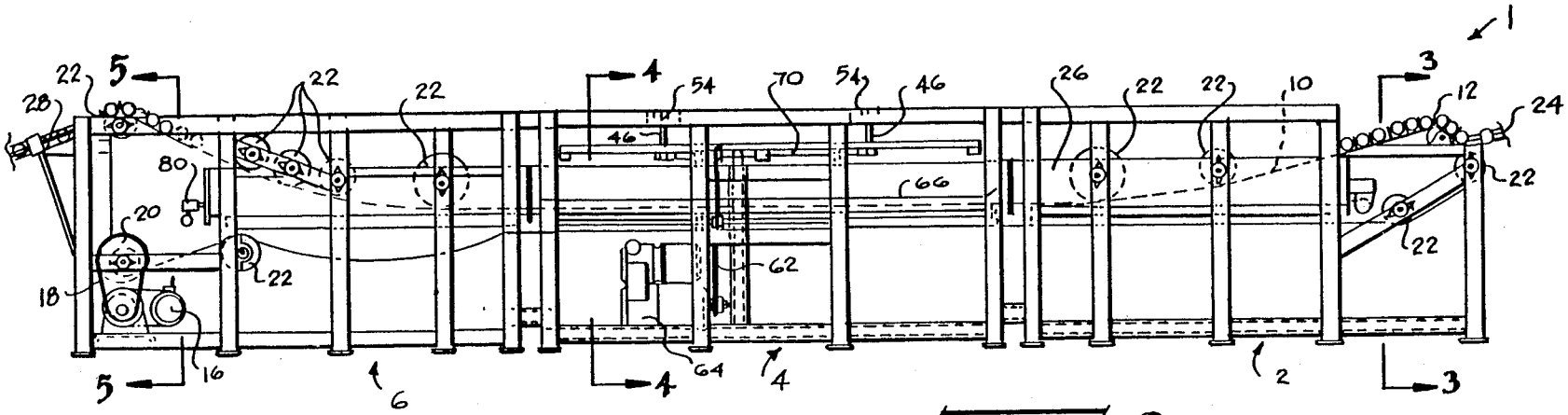
FIG. 2 is a side elevational view of the can cooler.

Turning now to the FIGURES, and particularly to FIGS. 1 and 2, the can cooling apparatus 1 employed in the present invention is illustrated. The apparatus 1 is formed in three sections, an entry section 2, a cooling section 4 and an exit section 6. The apparatus 1 is designed to be modular, that is, depending upon the specific cooling requirements of a given packing line, multiple cooling sections 4 or cooling sections 4 of varying lengths may be inserted between an entry section 2 and an exit section 6.

As illustrated, the apparatus 1 is a multi-lane apparatus, illustrated as having four separate lanes. It should be readily apparent, however, that the apparatus may be formed having a single lane or may have multiple lanes of more than or less than the four lanes illustrated.

Each of the lanes of the apparatus 1 includes an endless belt or chain 10 having cleats 12 spaced so as to receive a can 14 therebetween. The endless belt 10 is driven by motor 16 which, through chain 18, drives shaft 20 around which the belt 10 passes. A plurality of pulleys 22 along the path of belt 10 help guide belt 10 and maintain it in position.

The cans 14 enter belt 10 from an entry chute 24 which is partially shown in FIG. 2. The cans 10 enter and pass through apparatus 1 with their axes in a generally horizontal position. The cans 14 pass downwardly along with belt 10 through the entry section 2, entering water trough 26, and being substantially or completely submerged within trough 26 by the time the cans 14 reach the central cooling section 4. Throughout central cooling section 4, the cans 14 remain substantially or completely submerged, rising out of trough 26 in the exit section 6. The cans 14, as they leave exit section 6, exit along exit chute 28.

Figure 3:
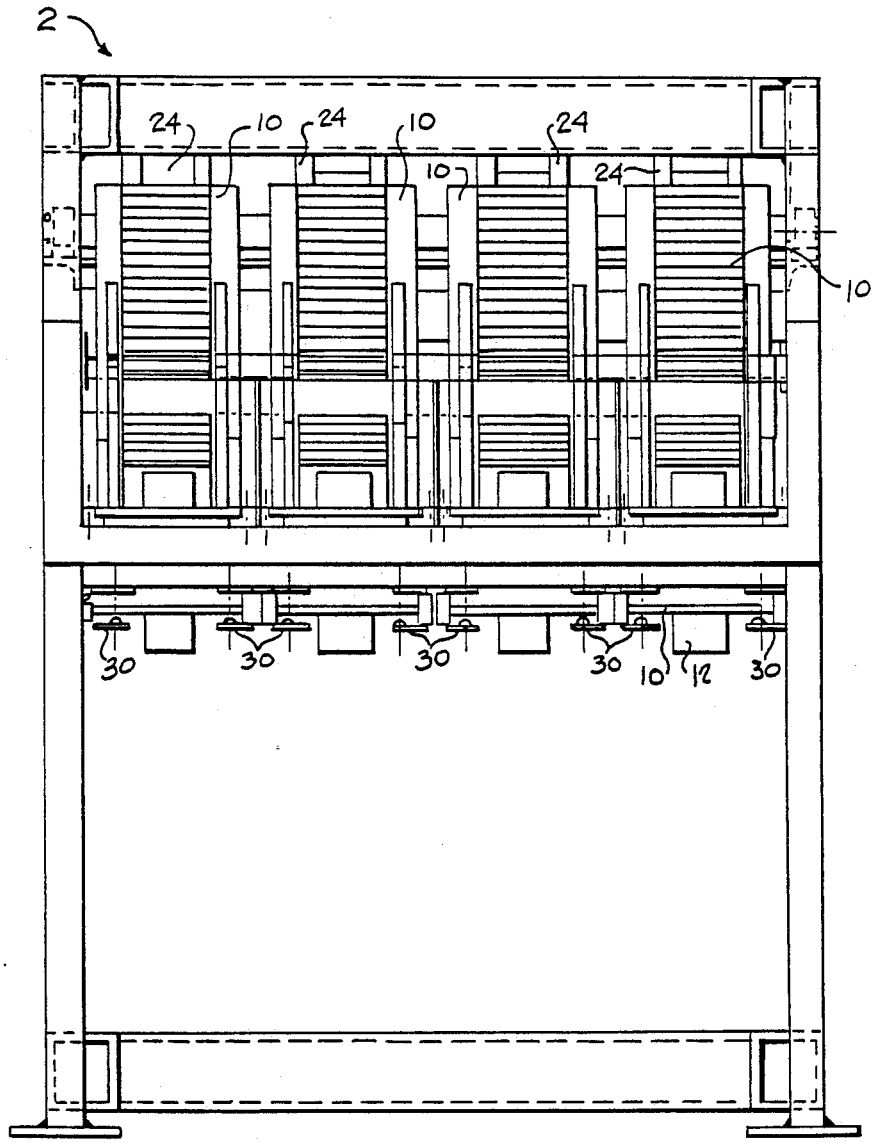
FIG. 3 is a cross-sectional view taken along line 3—3 of FIG. 2, illustrating the entrance to the can cooler.

FIG. 3 more fully illustrates the entry section 2 of the cooling apparatus 1. As can be seen in this FIGURE, the endless belts 10 are positioned to receive cans 14 from entry chutes 24. Also, belts 10 pass within supporting guides 30 during their return to entry chutes 24.

Figure 4:
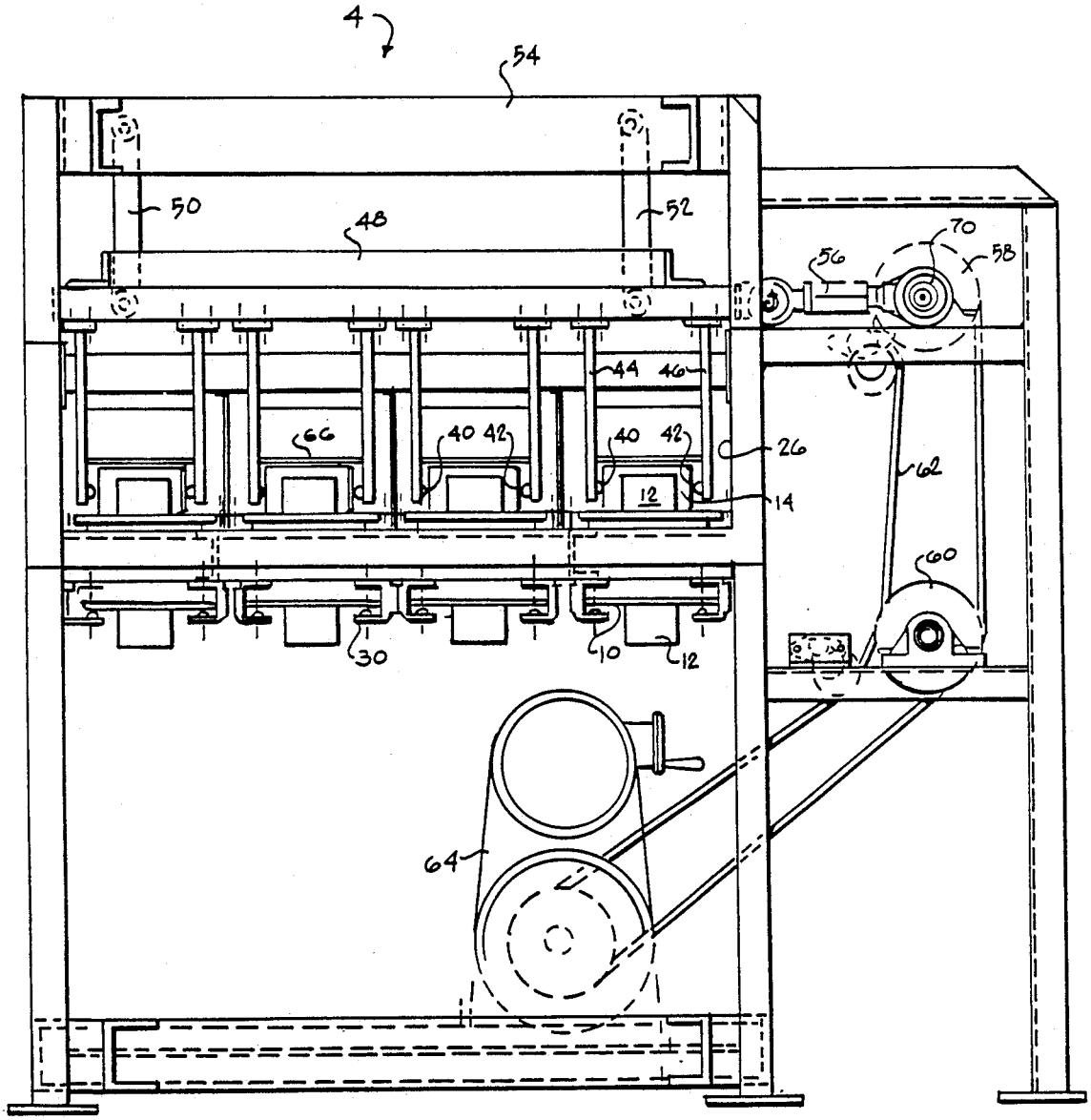
FIG. 4 is a cross-sectional view taken along line 4—4 of FIG. 2, illustrating the main cooling section of the can cooler.

The central section 4 of the can cooler 1 is illustrated in FIG. 4. This is the main cooling section of the cooler 1. As previously mentioned, the cooler 1 is designed to be modular, allowing multiple sections 4 or sections 4 of varying length to be inserted between entry section 2 and exit section 6.

Each of the cooling sections 4 includes a continuation of the water trough 26 therethrough. The water trough 26 is preferably filled to a level at or slightly above the height of the cans 14 as they pass along their sides within belt 10.

In addition to cooling provided to the cans 14 by their flowing countercurrently to the direction of water flow, additional cooling is provided by means of axial shaking of the cans 14. This is also accomplished within cooling section 4 and the action which occurs to accomplish this cooling will be more fully described below.

Each row of cans 14 passes between a pair of guide rails 40 and 42. The guide rails 40 and 42 each extend for substantially the entire length of cooling section 4 and are spaced to allow cans 14 to pass therebetween freely. The guide rails 40 and 42 are mounted on brackets 44 and 46, respectively. Brackets 44 and 46 hang downwardly from mounting rail 48, which is in turn mounted for transverse axial motion by means of pivots 50 and 52 attached to frame member 54.

Mounting rail 48 is also attached to eccentric 56. Eccentric 56 is driven by means of pulleys 58 and 60, belt or chain 62 and motor 64, as will be described below, such that eccentric 56 alternately pulls and pushes rail 48 axially, in turn causing reciprocal movement of mounting brackets 44 and 46 and rails 40 and 42. The reciprocal motion of rails 40 and 42 is transferred as axial shaking to cans 14.

As previously mentioned, the cans 14 within trough 26 are moving countercurrently to water flow. The water within trough 26 has a height covering at least the majority of the height of the cans 14 as they move along their sidewalls. Within water filled trough 26, the cans 14 become buoyant, and thus tend to float above belt 10, being moved through cooling section 4 by the belt cleats 12. So that cans 14 are held between adjacent cleats 12, an optional belt 66 stretches above trough 26 along the length of cooling section 4. The gentle contact of the cans 14 within the water trough 26, is unlike the rolling of cans along the conveying surfce as done in the past and does not damage the cans 14 or their graphics. For reasons that will be more fully described below, belt 66 is itself essentially neutrally buoyant, so that it limits, but does not prevent, vertical motion of the cans 14, when it is present.

The countercurrent flow of the cans 14 within trough 26, along with their optional contact with belt 66, rotates the cans 14 during their travel along cooling section 4. The rotation of cans 14 also aids in cooling transfer to the fluid within can 14, adding to the speed at which the fluid within can 14 is cooled. The combination of axial shaking and rotation of the can 14 provides far faster cooling of the contents of can 14 than spraying or other prior-known methods of can cooling.

As can best be seen in FIG. 2, depending upon the length of cooling section 4, multiple sets of mounting brackets 44 and 46, rails 48 and eccentrics 56 may be employed. To facilitate this, the eccentrics 56 may be mounted on a common shaft 70 which is driven by motor 64. Thus, pulley 58 is mounted along shaft 70, and the driving of pulley 58 accomplishes rotation of shaft 70 and the movements of eccentric 56.

Figure 5:
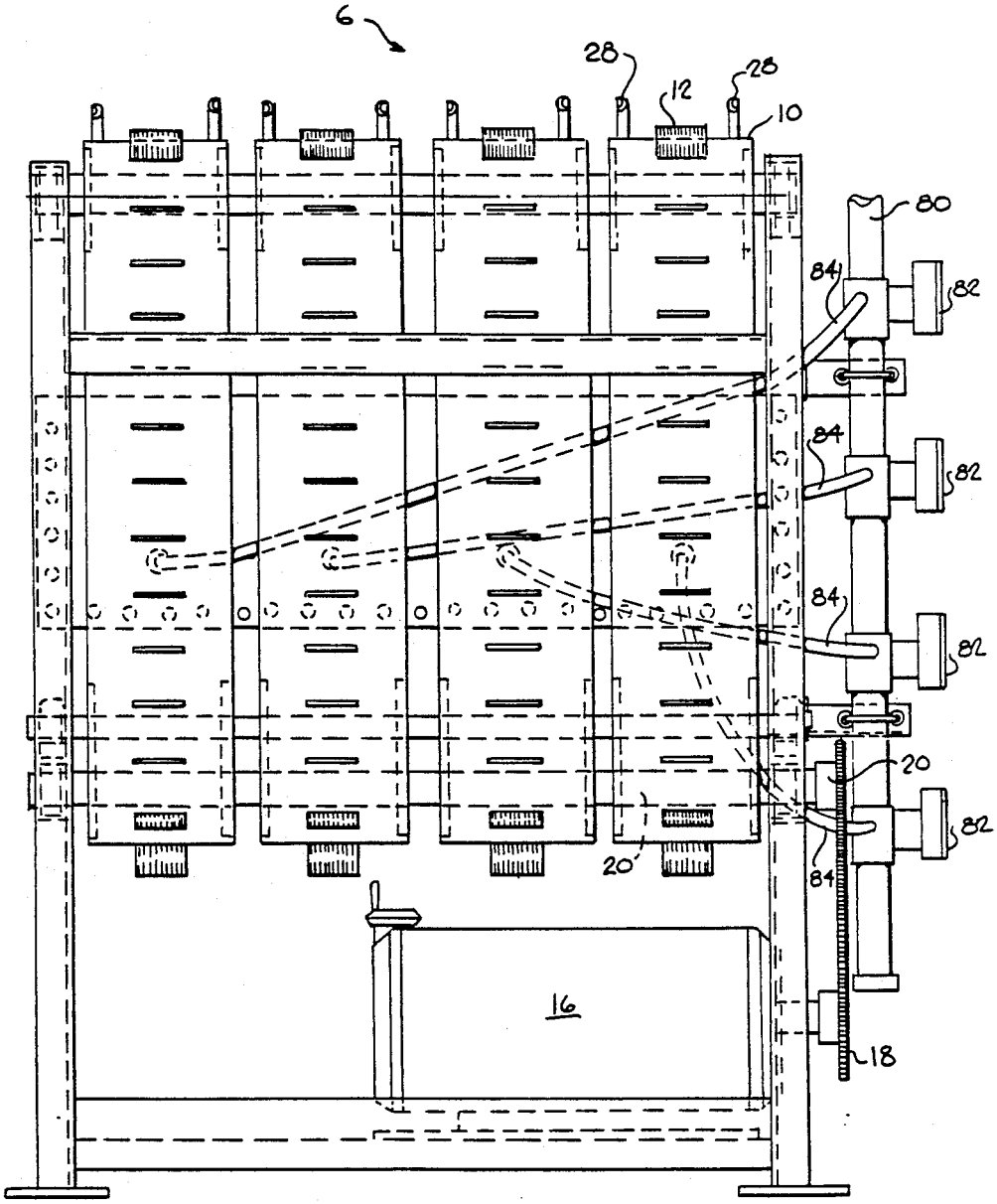
FIG. 5 is a cross-sectional view taken along line 5—5 of the FIG. 2, illustrating the exit portion of the can cooler.

FIG. 5 illustrates the exit section 6 of the cooling apparatus 1. In this section, the cans 14 exit belt 10 and travel through exit chutes 28 for further processing. In addition, the motor 16 and drive belt or chain 18 for endless belt 10 is illustrated. Also at this station 6, a water intake line 80 is connected to a water source (not shown). Valves 82 permit water to flow through lines 84 at controlled rates, providing the water supply for trough 26.

The entire apparatus 1 is inclined downwardly slightly from exit section 6 to entry section 2. This incline is slight, on the order of about 1° to about 3°, and provides for water flow in a countercurrent direction to the travel of the cans 14 and compensates for the friction between the water and the belt 10 and cans 14, so that water does not tend to accumulate at the exit section 6 of apparatus 1 when in operation. At exit station 3, a drain 90 is provided to capture water exiting trough 26. Typically, the cans entering the apparatus 1 are at a temperature of between about 190° and about 200° F. and exit the apparatus at a temperature of between about 80° and about 100° F. The water entering line 80 enters at a temperature of about 70° F. and exits of between about 100° and 150° F. The water exiting at drain 90 could be recooled and recycled, however, it is typically more cost effective to permit the water to pass directly to the waste water system of the plant.

The motion of the cans 14 within trough 26 will now be more fully described. As previously mentioned, the countercurrent flow of the cans 14 and water within trough 26, as well as the optional contact of the cans 14 with belt 66, rotates the cans about their axes. The rails 40 and 42 alternately accelerate the cans 14 along their axes in opposite directions. However, due to the physics of the cans 14, the actual motion of the cans 14 is not merely axial.

The cans 14 are up to about 95 percent by volume filled with liquid, with the remainder of their internal volume being gaseous. Further, the cans 14 are buoyant, such that they tend to float in trough 26. As the cans 14 are initially accelerated in a first direction, the liquid within the cans tends to move away from the leading end of the can 14, causing this end to become lighter than the trailing end of can 14 due to the gaseous head space now occupying a greater portion of the leading end, which in turn moves the center of gravity of can 14 toward the trailing end of can 14. The center of buoyancy, being a geometric property of the size and shape of the can 14, always remains stationary, however. Thus, the downward gravitational force at the center of gravity and the upward buoyancy force at the center of buoyancy act through different locations, causing the leading end of can 14 to rise above its horizontal position in trough 26.

Eventually, after acceleration of can 14 reaches zero, the gaseous headspace spreads evenly along can 14, causing the leading end to return to the horizontal, until acceleration in the opposite direction begins, when the force cycle reverses itself and the prior trailing end becomes the leading end, and rises in the manner previously described. Of course, the motions of the liquid and gas are not instantaneous.

The alternate rising and falling of the ends of can 14 produce a wavelike motion of the liquid within the cans 14, which motion produces added surface contact and high relative velocity between the liquid and the interior of can 14, providing superior cooling of the containers 14.

It should be noted that if the reciprocating movement of the cans 14 is too fast, the wavelike motion is reduced to a level such that insufficient cooling of the cans occurs, thus control of the speed of rails 40 and 42 is essential to operation according to the present invention.

Finally, it should also be noted that when belt 66 is present, the cans 14 may be somewhat limited in the ability of their ends to rise, tending to dampen somewhat the vertical movements of the cans 14, but still permitting sufficient motion for effective cooling of the cans 14. The ability of the cans to rise in the presence of belt 66 results from belt 66 being essentially neutrally buoyant itself such that it does not weigh down the cans 14 substantially, but merely acts to maintain the cans 14 in between adjacent cleats 12.

Clearly, the present invention is directed primarily to reducing the temperature of a heated and filled container. It should be apparent, however, that, if desired, the invention may be employed in the reverse; i.e., by using water in the trough at a temperature above that of the container contents, the contents may be heated in the same manner as described above.

From the foregoing, it is clear that the present invention provides a method for thermally treating cans which cools or heats the cans more effectively than other known systems, thus decreasing the size of the unit and water usage.

While the invention has been described with reference to certain specific embodiments thereof, it is not intended to be so limited thereby, except as set forth in the accompanying claims.

We claim:

1. A method for changing the temperature of filled and sealed containers, said containers being filled with a liquid and having a gaseous headspace therein, comprising orienting said containers onto their sides, passing said containers through a trough of water crosswise to their axes and countercurrent to the direction of travel of said water through said trough to thereby rotate said cans about their axes within said water, reciprocatingly accelerating said cans along their axes at a controlled rate to position said gaseous headspace at the leading ends of said cans during acceleration in a given direction and maintaining said water in said trough at a height covering at least the majority of the height of said cans as they move along their sidewalls to thereby alternately cause said ends of said cans to rise within said water.

2. The method of claim 1 wherein said passing includes positioning said cans in individual pockets.

3. The method of claim 2 further comprising restraining said cans from substantial vertical movement above said water.

4. The method of claim 1 wherein said reciprocatingly accelerating at a controlled rate produces a wavelike motion to said liquid within said containers.

5. The method of claim 1 wherein said containers are cans.

6. The method of claim 1 wherein said changing comprises cooling.

7. The method of claim 1 wherein said changing comprises heating.

* * * * *